US009466158B2

(12) United States Patent
Elnajjar

(10) Patent No.: US 9,466,158 B2
(45) Date of Patent: Oct. 11, 2016

(54) INTERACTIVE ACCESS TO VEHICLE INFORMATION

(71) Applicant: GENERAL MOTORS LLC, Detroit, MI (US)

(72) Inventor: Hassan Elnajjar, Dearborn, MI (US)

(73) Assignee: General Motors LLC, Detroit, MI (US)

( * ) Notice: Subject to any disclaimer, the term of this patent is extended or adjusted under 35 U.S.C. 154(b) by 0 days.

(21) Appl. No.: 14/559,110

(22) Filed: Dec. 3, 2014

(65) Prior Publication Data

US 2016/0163129 A1 Jun. 9, 2016

(51) Int. Cl.

| | |
|---|---|
| ***G07C 5/08*** | (2006.01) |
| ***G07C 5/00*** | (2006.01) |
| ***G07C 5/12*** | (2006.01) |

(52) U.S. Cl.

CPC ..... *G07C 5/0808* (2013.01); *G07C 5/008* (2013.01); *G07C 5/12* (2013.01)

(58) Field of Classification Search

CPC ..... G07C 5/0808; G07C 5/008; G07C 5/12

USPC ..... 701/29.6

See application file for complete search history.

(56) References Cited

U.S. PATENT DOCUMENTS

| | | | | |
|---|---|---|---|---|
| 5,504,674 | A * | 4/1996 | Chen | G06Q 50/00 345/667 |
| 8,478,480 | B2 * | 7/2013 | Mian | G01M 17/013 250/316.1 |
| 8,515,152 | B2 * | 8/2013 | Siri | 382/141 |
| 8,798,324 | B2 * | 8/2014 | Conradt | G06K 9/4604 382/104 |
| 2009/0138290 | A1 * | 5/2009 | Holden | G06Q 10/087 705/4 |
| 2014/0067429 | A1 * | 3/2014 | Lowell | G06Q 40/08 705/4 |
| 2014/0226010 | A1 * | 8/2014 | Molin | G06Q 10/06 348/148 |
| 2015/0100504 | A1 * | 4/2015 | Binion | G06Q 30/0278 705/306 |
| 2015/0112543 | A1 * | 4/2015 | Binion | G07C 5/12 701/32.2 |

* cited by examiner

*Primary Examiner* — Behrang Badii
*Assistant Examiner* — Michael Berns
(74) *Attorney, Agent, or Firm* — Leydig, Voit & Mayer, Ltd.

(57) ABSTRACT

Implementations of the present invention contemplate utilizing the communicative connections between a telematics service provider (TSP), a communication device, and a telematics unit in a vehicle to interactively provide information pertaining to various components of a vehicle. Implementations contemplate that an image capture device is communicatively connected to the telematics unit in a vehicle and an operations control center of the TSP. Image data pertaining to an image captured by the image capture device is analyzed and vehicle components included in the image are identified. Once vehicle components in the image have been identified, information pertaining to the identified components is presented as an overlay of the originally captured image.

20 Claims, 6 Drawing Sheets

| |
|---|
| User Identification Field **310** |
| Vehicle Identification Field **320** |
| Image Data Field **330** |
| Candidate Component Region Coordinate Field **340** |
| Reference Image Data Field **350** |
| Vehicle Component Identifier Field **360** |
| Identified Component Region Coordinate Field **370** |

FIG. 3

INTERACTIVE ACCESS TO VEHICLE INFORMATION

TECHNOLOGY FIELD

The present disclosure relates generally to vehicular telematics systems and more specifically to the use of a connection between a mobile device and a telematics unit within a vehicle to provide interactive systems and methods for accessing vehicle information.

BACKGROUND

Telematics units within mobile vehicles provide subscribers with connectivity to a telematics service provider (TSP). The TSP provides subscribers with an array of services ranging from emergency call handling and stolen vehicle recovery to diagnostics monitoring, global navigation system aided position identification, map services, and turn-by-turn navigation assistance. Telematics units are often provisioned and activated at a point of sale when a subscriber purchases a telematics-equipped vehicle. Once provisioned and activated, telematics units can be utilized by a subscriber to obtain telematics services, such as those described herein, from the TSP.

Recently, with the increasing popularity of computerized mobile devices such as tablet computers and smart phones, vehicles have provided means for establishing communicative connections with computerized communication devices that are distinct from the vehicle hardware itself. For example, BLUETOOTH units within vehicles enable short range communicative connections to be established between vehicle hardware and such computerized communication devices. Such short range communicative connections enable the computerized communication devices to utilize the output capabilities of the vehicle and enable the vehicle to utilize the processing power and information accessing capabilities of the computerized communication devices for various applications.

SUMMARY OF THE INVENTION

A method is provided herein for providing information about a component of a vehicle, the method comprising acquiring image data corresponding to an image of a portion of the vehicle collected by an image capture device, identifying the component of the vehicle in the collected image, requesting information corresponding to the component of the vehicle identified in the collected image, receiving information corresponding to the component of the vehicle identified in the collected image, and providing for display image data corresponding to the image collected by the image capture device and an overlay including the information corresponding to the component of the vehicle identified in the collected image.

A computer readable medium is provided herein that has stored thereon instructions providing for acquiring image data corresponding to an image of a portion of the vehicle collected by an image capture device, identifying the component of the vehicle in the collected image, requesting information corresponding to the component of the vehicle identified in the collected image, receiving information corresponding to the component of the vehicle identified in the collected image, and providing for display image data corresponding to the image collected by the image capture device and an overlay including the information corresponding to the component of the vehicle identified in the collected image.

A system is provided herein for providing information about a component of a vehicle, the system comprising a computerized communication device having a processor and processor readable electronic storage media having stored thereon instructions providing for acquiring image data corresponding to an image of a portion of the vehicle collected by an image capture device, identifying the component of the vehicle in the collected image, requesting information corresponding to the component of the vehicle identified in the collected image, receiving information corresponding to the component of the vehicle identified in the collected image, and providing for display image data corresponding to the image collected by the image capture device and an overlay including the information corresponding to the component of the vehicle identified in the collected image; a telematics unit of the vehicle having a processor and processor readable electronic storage media having stored thereon instructions providing for receiving a request for information corresponding to the component of the vehicle identified in the collected image and providing diagnostics information pertaining to the current condition of the component of the vehicle; a server having a processor and processor readable electronic storage media having stored thereon instructions providing for receiving a request for information corresponding to the component of the vehicle identified in the collected image, and providing information comprising instructions for using the component of the vehicle.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

FIG. 3 is an example diagram of a data structure utilized in identifying vehicle components contained in a captured image;

DETAILED DESCRIPTION OF THE DRAWINGS

Implementations of the systems, methods, and hardware described herein contemplate interactively providing various information pertaining to a vehicle through the communicative connections between a computerized communication device distinct from the vehicle, a telematics unit integrated into the vehicle, and an operations control center (OCC) of a telematics service provider (TSP). Implementations contemplate providing a human-machine interface through a computerized communication device distinct from a vehicle that is capable of providing an image of various vehicle components and an overlay that includes information pertaining to the vehicle components displayed in the image. The information included in the overlay can include information pertaining to the current status of vehicle components displayed in the image and can also include information on the capabilities of the vehicle components displayed in the image. Depending on the identity and classification of the vehicle components displayed in the image, the information in the overlay can also include instructions on how to use the displayed components.

Implementations contemplate the transfer of image data from the computerized communication device distinct from the vehicle to the vehicle itself and to the OCC of the TSP. Also contemplated is the transfer of information indicative of the identities of various vehicle components displayed in an image to which the image data pertains and information pertaining to those vehicle components from the OCC of the TSP to both the telematics unit of the vehicle and the computerized communication device. Further contemplated is the transfer of information pertaining to the vehicle components displayed in the image from the telematics unit to both the OCC of the TSP and to the computerized communication device.

Through implementations of the systems, methods, and hardware described herein, a user can capture images of components of a vehicle and request an overlay of the image that provides information pertaining to the components of the vehicle in the captured image. The user can thereby easily learn how to use certain vehicle functions and features and also to intuitively perform a diagnostic evaluation of a vehicle in order to, e.g., determine which components of the vehicle need maintenance.

Figure 1:
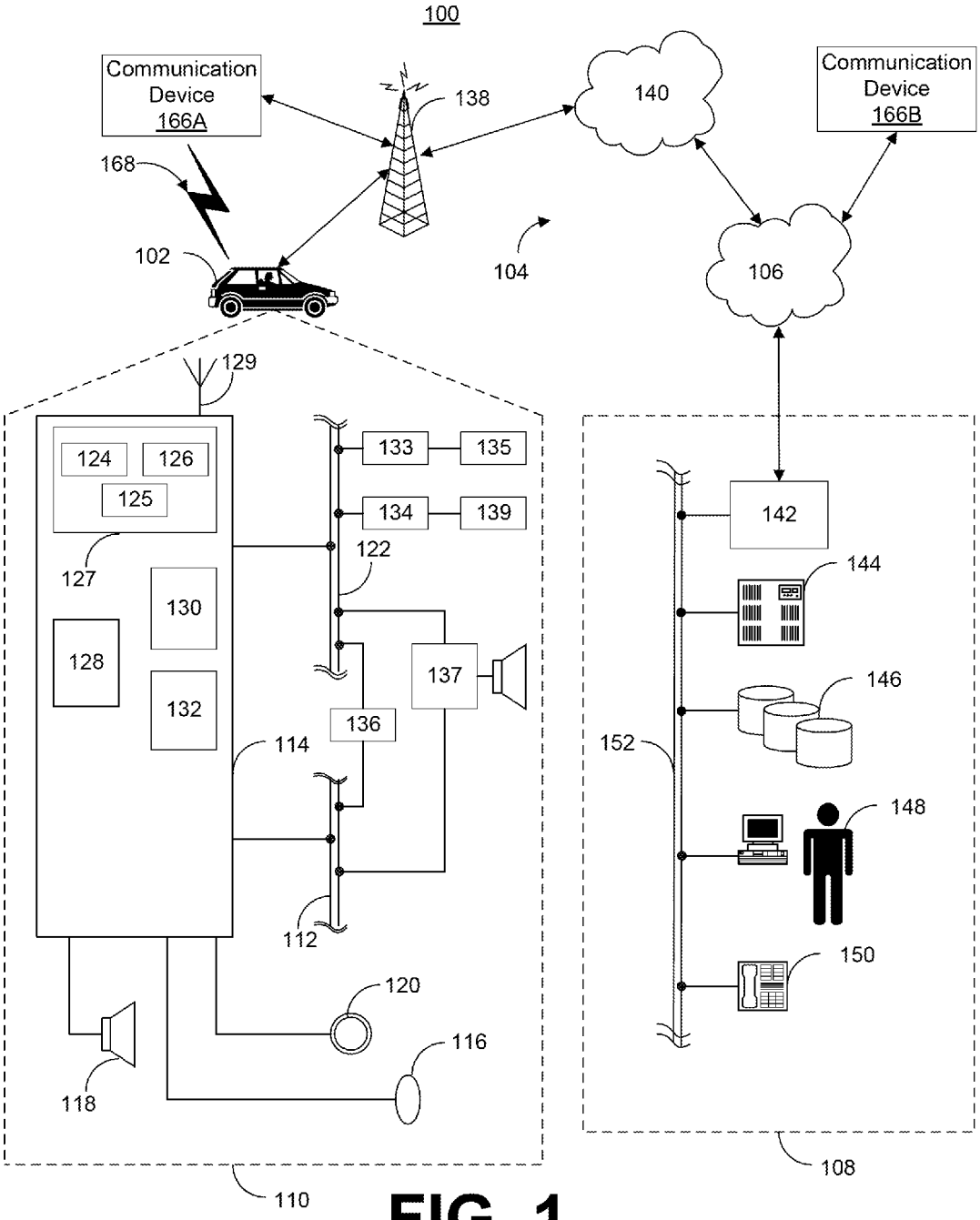
FIG. 1 is a schematic diagram of an operating environment for a mobile vehicle communication system usable in implementations of the described principles.

Before discussing the details of the invention, a brief overview of an example telematics system is given to guide the reader. FIG. 1 schematically depicts an example environment for carrying out the invention. It will be appreciated that the described environment is an example, and does not imply any limitation regarding the use of other environments to practice the invention. With reference to FIG. 1 there is shown an example of a communication system 100 that can be used with the present implementations and generally includes a vehicle 102, a mobile wireless network 104, a land network 106, and an operations control center (OCC) 108 of a telematics service provider (TSP). The communication system 100 further includes communication devices 166A and 166B. It should be appreciated that the overall architecture, setup and operation, as well as the individual components of a system such as that shown in FIG. 1 are generally known in the art. Thus, the following paragraphs provide a brief overview of one such example communication system 100. However, implementations could be carried out in other environments as well.

Vehicle 102 is a mobile vehicle such as a motorcycle, car, truck, recreational vehicle (RV), boat, plane, etc., and is equipped with suitable hardware and software that enables it to communicate over the communication system 100. The vehicle 102 includes vehicle hardware 110 that, as shown generally in FIG. 1, includes a telematics unit 114, a microphone 116, a speaker 118, and buttons and/or controls 120 connected to the telematics unit 114. A network connection or vehicle bus 122 is operatively coupled to the telematics unit 114. Examples of suitable network connections include a controller area network (CAN), a media oriented system transfer (MOST), a local interconnection network (LIN), an Ethernet, and other appropriate connections such as those that conform with known ISO, SAE, and IEEE standards and specifications, to name but a few.

The telematics unit 114 is an onboard device capable of providing a variety of services through its communicative connection with the OCC 108 and generally includes an electronic processing device 128 that can include one or more application processors that each includes one or more processor cores, one or more types of electronic memory 130, a cellular chipset/component 124, a wireless modern 126, a dual mode antenna 129 (e.g. a radio frequency transceiver), and a navigation unit containing a GPS chipset/component 132. The OPS chipset/component is capable of determining the location of the vehicle with a high degree of accuracy. In one example, the wireless modem 126 comprises, and is carried out in the form of, a computer program and/or set of software routines executing within the electronic processing device 128. Alternatively, the wireless modern 126 comprises, and is carried out in the form of, a set of computer executable instructions stored at and carried out by the cellular chipset/component 124. The cellular chipset/component 124 and the wireless modem 126 can be called a network access device (NAD) 127 of the telematics unit 114. The NAD 127 further includes a short-range wireless unit 125 capable of communicating with a user's mobile device such as a cellular phone, tablet computer, PDA, or the like, over a short-range wireless protocol. For example, in one implementation, the short-range wireless unit 125 is a BLUETOOTH unit with an RF transceiver that communicates with a user's mobile device using BLUETOOTH protocol.

The telematics unit 114 provides a variety of services for subscribers. Examples of such services include: turn-by-turn directions and other navigation-related services provided in conjunction with the GPS based chipset/component 132; airbag deployment notification and other emergency or roadside assistance-related services provided in connection with various crash and or collision sensor interface modules 133 and sensors 135 located throughout the vehicle.

GPS navigation services are implemented based on the geographic position information of the vehicle provided by the GPS based chipset/component 132. A user of the telematics unit enters a destination using inputs corresponding to the GPS component, and a route to a destination is calculated based on the destination address and a current position of the vehicle determined at approximately the time of route calculation. Turn-by-turn (TBT) directions can further be provided on a display screen corresponding to the GPS component and/or through vocal directions provided through a vehicle audio component 137. It will be appreciated that the calculation-related processing can occur at the telematics unit or can occur at the OCC 108.

Infotainment-related services are provided by the TSP wherein music, Web pages, movies, television programs, video games and/or other content is downloaded to an infotainment center 136 operatively connected to the telematics unit 114 via a vehicle bus 122 and an audio bus 112. In one example, downloaded content is stored for current or later playback.

The preceding list of functions is by no means an exhaustive list of all of the capabilities of telematics unit 114, as should be appreciated by those skilled in the art, but is simply an illustration of some of the services that the telematics unit 114 offers. Furthermore, the telematics unit 114 can include a number of components known by those skilled in the art in addition to those described above.

Vehicle communications use radio transmissions to establish a communications channel within the mobile wireless network 104 so that voice and/or data transmissions occur over the communications channel. Vehicle communications are enabled via the cellular chipset/component 124 for voice communications and a wireless modem 126 for data transmission. To enable successful data transmission over the communications channel, wireless modem 126 applies some form of encoding or modulation to convert the digital data so that it can communicate through a vocoder or speech codec incorporated in the cellular chipset/component 124. Any suitable encoding or modulation technique that provides an acceptable data rate and bit error can be used with the present method. The dual mode antenna 129 services the GPS chipset/component and the cellular chipset/component.

The microphone 116 provides the driver or other vehicle occupant with a means for inputting verbal or other auditory commands, and can be equipped with an embedded voice processing unit utilizing a human/machine interface (HMI) technology known in the art. Conversely, the speaker 118 provides verbal output to the vehicle occupants and can be either a stand-alone speaker specifically dedicated for use with the telematics unit 114 or can be part of the vehicle audio component 137. In either event, the microphone 116 and the speaker 118 enable vehicle hardware 110 and the OCC 108 to communicate with the occupants through audible speech.

The vehicle hardware also includes the one or more buttons or controls 120 configured to enable a vehicle occupant to activate or engage one or more of the vehicle hardware components 110. For example, one of the buttons 120 is an electronic push button that, when pressed, initiates voice communication with the OCC 108 (whether it be a phone bank manned by live advisors 148 or an automated call response system). In another example, one of the buttons 120, when pushed, initiates emergency services.

The audio component 137 is operatively connected to the vehicle bus 122 and the audio bus 112. The audio component 137 receives analog information, rendering it as sound, via the audio bus 112. Digital information is received via the vehicle bus 122. The audio component 137 provides AM and FM radio, CD, DVD, and multimedia functionality independent of the infotainment center 136. The audio component 137 contains a speaker system, or alternatively utilizes the speaker 118 via arbitration on the vehicle bus 122 and/or the audio bus 112.

The vehicle crash and/or collision detection sensor interface 133 is operatively connected to the vehicle bus 122. The crash sensors 135 provide information to the telematics unit 114 via the crash and/or collision detection sensor interface 133 regarding the severity of a vehicle collision, such as the angle of impact and the amount of force sustained.

Vehicle sensors 139, connected to various sensor interface modules 134 are operatively connected to the vehicle bus 122. Vehicle sensors 139 include sensors with capabilities that include but that are not limited to determining a battery's state of charge (e.g. as a percentage of the total charge capacity), the charging status of a battery (i.e. whether the battery is currently being charged), and the current rate at which the battery is being charged (e.g. as a rate of change of the percentage of capacity charged per unit time). The vehicle sensors 139 can also include but are not limited to gyroscopes, accelerometers, magnetometers, emission detection and/or control sensors, and the like. The sensor interface modules 134 can include power train control, climate control, and body control, to name but a few.

Communication devices 166A and 166B are capable of being communicatively connected to the OCC 108 and the vehicle hardware 110. Communication device 166A is connected to the OCC 108 and the vehicle hardware 110 through the mobile wireless network 104, while communication device 166B is connected to the OCC 108 and the vehicle hardware 110 through land network 106 and the mobile wireless network 104. The communication device 166A is also connected to the vehicle hardware 110 through a short range wireless connection 168, e.g. a Bluetooth or Bluetooth low energy (BLE) connection enabled by the short-range wireless unit 125 of the NAD 127. Alternatively, the short range wireless connection 168 between the communication device 166A and the vehicle hardware 110 can be made through a WiFi or other short range wireless connection. Although communication device 166B is not depicted as having an active short range wireless communication with the telematics unit 114, it, like the communication device 166A, can be a mobile device that belongs to one or more users of the vehicle 102 and that is equipped with Bluetooth units and RF transceivers that allows it to communicate with the vehicle telematics unit 114 via the short-range wireless unit 125 of the NAD 127.

The communication devices 166A and 166B can be any of a smart phone, a tablet computer, a personal digital assistant (PDA), a laptop computer, a desktop computer, or any other device capable of sending and receiving transmissions via a voice or data network. The communication devices 166A and 166B include one or more processors and electronic storage media capable of storing processor executable instructions that specify processing routines of processor executable applications. Implementations described herein contemplate that the communication devices 166A and 166B are either equipped with an integrated camera or image capture device or are communicatively connected with a camera or image capture device.

The mobile wireless network 104 can be a cellular telephone system or any other suitable wireless system that transmits signals between the vehicle hardware 110 and the land network 106. According to an example, the mobile wireless network 104 includes one or more cell towers 138, base stations and/or mobile switching centers (MSCs) 140, as well as any other networking components required to connect the mobile wireless network 104 with the land network 106. The mobile switching center can include a remote data server.

As appreciated by those skilled in the art, various cell tower/base station/MSC arrangements are possible and could be used with the mobile wireless network 104. For example, a base station and a cell tower could be co-located at the same site or they could be remotely located from one another, a single base station could be coupled to various cell towers, and various base stations could be coupled with a single MSC, to name but a few of the possible arrangements. Preferably, a speech codec or vocoder is incorporated in one or more of the base stations, but depending on the particular architecture of the wireless network, it could be incorporated within a Mobile Switching Center or some other network component as well.

The land network 106 is, for example, a conventional land-based telecommunications network connected to one or more landline telephones and connecting wireless carrier network 104 to call center 108. For example, the land network 106 includes a public switched telephone network (PSTN) and/or an Internet protocol (IP) network, as is appreciated by those skilled in the art. Of course, one or more segments of the land network 106 are implemented in the form of a standard wired network, a fiber or other optical network, a cable network, other wireless networks such as wireless local networks (WLANs) or networks providing broadband wireless access (BWA), or any combination thereof.

The OCC 108 of the telematics service provider is designed to provide the vehicle hardware 110 with a number of different system back-end services and/or functions and, according to the example shown here, generally includes one or more switches 142, servers 144, databases 146, phone banks used by live advisors 148, and a variety of other telecommunication and computer equipment 150 that is known to those skilled in the art. Although the illustrated example has been described as it would be used in conjunction with a manned call center, it will be appreciated that the OCC 108 can be any central or remote facility, manned or unmanned, mobile or fixed, to or from which it is desirable to exchange voice and data.

The various components of the OCC 108 are coupled to one another, for example, via a network connection or bus 152, such as the one previously described in connection with the vehicle hardware 110. Switch 142, which can be a private branch exchange (PBX) switch, routes incoming signals so that voice transmissions are usually sent to either the phone banks manned by live advisors 148 or an automated response system and so that data transmissions are passed on to a modem or other piece of telecommunication and computer equipment 150 for demodulation and further signal processing.

The telecommunication and computer equipment 150 includes a modem that preferably includes an encoder, as previously explained, and can be connected to various devices such as the servers 144 and the databases 146. The telecommunication and computer equipment 150 includes hardware that provides a means by which the servers 144 can access the databases 146 in order to request information from the databases 146. Furthermore, the telecommunication and computer equipment 150 allows for the receipt and routing of requests from applications executing at the telematics unit 114 of the vehicle 102 or at one of the communication devices 166A and 166B. For example, the telecommunication and computer equipment 150 allows for the receipt and routing of signals that carry image data and a request for the identification of vehicle components included in the image represented by the image data.

The servers 144 include a number of processors as well as computer readable storage media that have stored thereon processer executable instructions that provide routines that are specified by one or more server-side applications. For example, the servers 144 are configured to execute applications that enable the identification of various vehicle components included in an image and the providing of information pertaining to the identified vehicle components. Such applications provide, e.g. routines by which the servers 144 can receive a request from an application executing on one of the communication devices 166A and 166B.

The databases 146 include a number of high capacity electronic storage devices that can include RAM, ROM, PROM, volatile, nonvolatile, or other electronic memory. The databases 146 are configured to store subscription records and any other pertinent subscriber information. The databases 146 are also configured to store information pertaining to the appearance of various vehicle components and other information that can be utilized in ascertaining the identity of components found in an image of a portion of a vehicle as captured by a computerized communication device equipped with a camera.

In general terms, not intended to limit the claims, the example environment depicted by FIG. 1 can be used by various hardware, systems, methods, and processes that utilize the communicative connections between the TSP (through the OCC 108) and one or both of the telematics unit 114 and a communication device selected from the group of communications devices 166A and 166B to provide a user with an image of one or more vehicle components upon which an overlay is provided that includes information pertaining to the imaged components. Implementations contemplate the capture of an image of one or more vehicle components, the identification of the imaged vehicle components through analysis of the image data, the acquisition of information pertaining to the identified vehicle components, the construction of an image overlay that displays the acquired information pertaining to the identified vehicle components, and the output of the image of the vehicle components with the image overlay.

Figure 2:
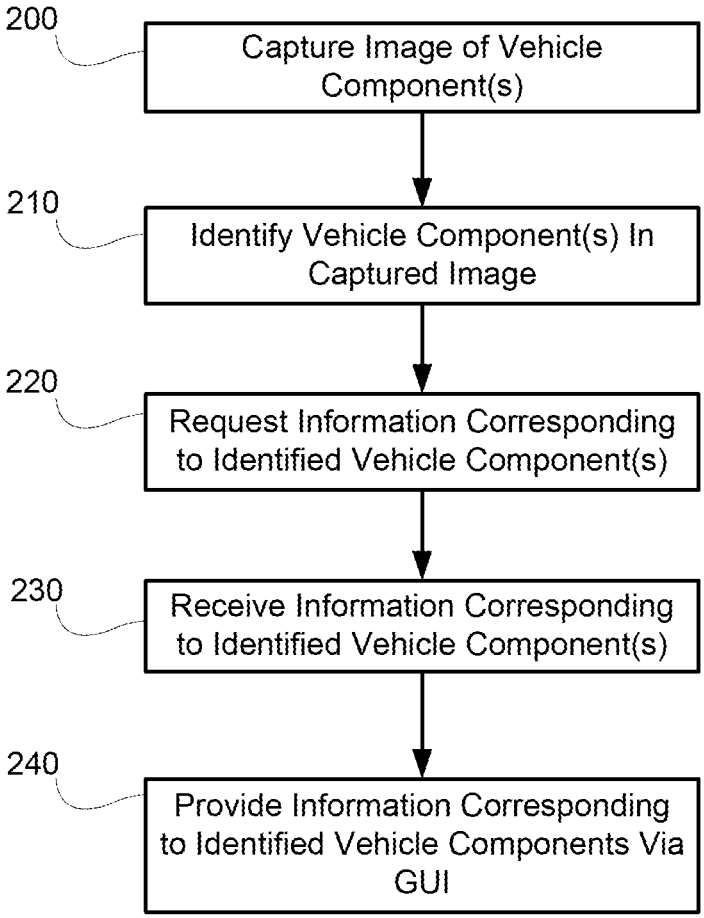
FIG. 2 is a flow diagram illustrating a process implemented by a computerized communication device for interactively providing access to vehicle information.

FIG. 2 is a flow diagram illustrating a process implemented by a computerized communication device, i.e. the communication device 166A, for interactively providing access to vehicle information. Implementations described herein contemplate that the communication device 166A implementing the process depicted in FIG. 2 can be any device that has an integrated image capture device or is communicatively connected to an image capture device and that is also capable of establishing a communicative connection with one or both of the telematics unit 114 of the vehicle 102 and the OCC 108. At step 200, the process captures an image of one or more components of the vehicle 102. For example, the process can capture an image of one of the tires of the vehicle 102 or the process can capture an image of the control console for a moonroof of the vehicle 102. Implementations described herein contemplate that an image including any one or more of a wide variety of components of the vehicle 102 can be captured. In some implementations, the capture of an image at step 200 can be accomplished with a video camera. In such implementations, the capture of the image at step 200 is performed continuously.

At step 210, the process identifies the vehicle components in the captured image. Implementations are contemplated herein wherein the entirety of the processing required to identify the vehicle components included in the captured image is performed by the communication device 166A. Alternatively, the processing required for the identification of the vehicle components in the captured image in the flow diagram illustrated in FIG. 2 can be entirely outsourced by the communication device 166A, e.g. to one or more of the servers 144 of the OCC 108 and to the electronic processing device 128 of the telematics unit 114 of the vehicle 102 or to a combination thereof. Finally, the processing required for the identification of the vehicle components in the captured image in the flow diagram illustrated in FIG. 2 can be partially performed by the communication device 166A and partially outsourced by the communication device to one or more of the servers 144 of the OCC 108 and to the electronic processing device 128 of the telematics unit 114 of the vehicle 102 or to a combination thereof. Therefore, the specific action taken during step 210 of the process depicted in FIG. 2 can vary from one implementation to another.

At step 210, the process can create a data structure used during the identification of the vehicle components in the captured image, such as the data structure represented by FIG. 3. FIG. 3 depicts a data structure used during, e.g., step 210. The data structure 300 depicted in FIG. 3 includes, by way of example, user identification field 310, vehicle identification field 320, image data field 330, candidate component region coordinate field 340, reference image data field 350, vehicle component identifier field 360, and identified component region coordinate field 370. The data structure depicted in FIG. 3 is merely an example and alternative data structures that omit particular fields depicted in FIG. 3 or include additional fields not depicted in FIG. 3 are also contemplated herein.

The user identification field 310 can be determined from an identifier of the communication device 166A and can be populated by a value that corresponds to a subscriber record data structure stored, e.g., at the databases 146 of the OCC 108. Alternatively, the user identification field 310 can be determined from input provided by a user of the communication device 166A in response to the production of a prompt at the communication device 166A. The vehicle identification field 320 can be determined from an identifier of the vehicle 102, or from an identifier of a component thereof, e.g. an international mobile subscriber identity (IMSI) of the telematics unit 114. The identifier of the vehicle 102 can be acquired via the short range wireless connection 168 between the communication device 166A and the vehicle 102. The image data field 330 can be populated with data corresponding to the image captured at step 200. The candidate component region coordinate field 340 and the identified component region coordinate field 370 are populated with one or more entries that correspond to locations within the image data at which vehicle component candidates and identified vehicle components, respectively, are located. The reference image data field 350 can be populated with a variety of entries that correspond to an image used by the process to identify vehicle components within the image captured at step 200. The vehicle component identifier field 360 can be populated with entries that identify a vehicle component identified in the image data captured at step 200. In addition, various entries in the fields of the data structure 300 can include an index value that establishes a link to one or more entries in other fields of the data structure 300. For example, an entry in the vehicle component identifier field 360 can include an index that links it to an entry in the identified component region coordinate field 370.

The data structure depicted in FIG. 3 can be stored at a single location or distributed across multiple locations. For example, a portion of the data structure depicted in FIG. 3 can be stored at the databases 146 of the OCC 108 while another portion of the data structure depicted in FIG. 3 is stored at the telematics unit 114 of the vehicle 102. Similarly, multiple copies of all or a portion of the data structure depicted in FIG. 3 can be stored at multiple locations. Various fields of the data structure depicted in FIG. 3 can also include a pointer to a field of a data structure stored at a different location. For example, a data structure corresponding to the data structure depicted in FIG. 3 or a portion thereof stored at the vehicle 102 can include a pointer to a data structure corresponding to the data structure depicted in FIG. 3 or a portion thereof stored at the OCC 108.

In implementations where the communication device 166A performs the entirety of the processing required for identification of the vehicle components included in the image captured at step 200, the communication device 166A may need to acquire additional information from the OCC 108 or from additional sources in order to perform the processing required to identify all of the vehicle components included in the image. In such implementations, the process can create the data structure depicted in FIG. 3 at the communication device 166A and populate the various fields of the data structure with information acquired from the OCC 108 or from the vehicle 102. For example, the process can request a vehicle identifier from the vehicle 102 and populate the vehicle identification field 320 with a vehicle identifier received from the vehicle 102. In some implementations, the communication device 166A can perform a first preprocessing step at step 210 of the process during which portions of the image that are candidates for including a vehicle component are identified according to various image processing and pattern recognition processes and operations. The portions of the image that are identified as candidates for including a vehicle component are identified by entries stored in a candidate component region coordinate field of the data structure created at step 210. In various implementations, the first preprocessing step can use a value of an entry stored in a vehicle identification field of the data structure created at step 210 that corresponds to a vehicle make and model in order to improve the accuracy with which portions of the image that are candidates for including a vehicle component are identified.

A second preprocessing step may also be performed in step 210 of the process by the communication device 166A during which each portion of the image that is identified as being a candidate for including a vehicle component is classified according to the one of a number of predetermined classes that corresponds to a vehicle user control component that might be included in the portion of the image. The classes are determined according to the shapes and other image data recognized during the first preprocessing step. For example, the prevalence of circular shapes, the prevalence of rectangular shapes, a black/white balance, a prevalence of certain colored pixels, and a variety of additional metrics can be used to determine which class to assign to a portion of an image that has been determined to be a candidate for including a vehicle component. The second preprocessing step can therefore append a classifier representative of a candidate image portion classification to one or more of the entries stored in a candidate component region coordinate field of the data structure created at step 210.

Upon completion of the second preprocessing step, the communication device 166A can request content that is determined according to the classes assigned to the portions of the image identified as being candidates for containing an identifiable vehicle component. For example, the content can include a variety of image data to use as a reference for comparison with the image data captured at step 200. The image data received in response to the request to determine the identity of a vehicle component can be stored as entries in a reference image data field of the data structure created at step 210.

Thereafter, the communication device 166A can utilize the information received in response to the to the request to determine the identity of a vehicle component included in each of the portions of the image identified as being a candidate for including a vehicle component. Alternatively, the communication device 166A can determine that one or more portions of the image that were identified as being candidates for including a vehicle component do not include any identifiable vehicle components.

In some implementations, additional preprocessing routines are executed during which each portion of the image that is identified as being a candidate for including a vehicle component is assigned to any one of various higher level classes and additional content determined according to the higher level classes is downloaded and utilized to assign each portion of the image that has been identified as being a candidate for including a vehicle component to an even higher level class. In such implementations, candidate portions of the image are assigned to higher and higher level classes until the process is able to identify a specific vehicle component found in the portion of the image. In some instances, a portion of the image identified as being a candidate for containing a vehicle component can be divided into multiple portions that each are identified as being candidates for containing a vehicle component, and further preprocessing is performed independently for each portion.

In implementations where the communication device 166A outsources the entirety of the processing required to identify the vehicle components included in the image captured at step 200, the communication device 166A transmits image data corresponding to the image captured at step 200 along with a request to identify the vehicle components included in the image. In such implementations, the communication device 166A can transmit the image data corresponding to the image captured at step 200 to the servers 144 of the OCC 108 via the mobile wireless network 104 and the land network 106, In implementations where the image data is transmitted to the OCC 108, the communication device 166A may transmit the image data to the OCC 108 via the mobile wireless network104 and the land network 106 along with a request that the OCC 108 forward the image data to the telematics unit 114 of the vehicle 102, In this manner the communication device 166A may further transmit the image data to the telematics unit 114 of the vehicle 102 via the 0CC 108. Thereafter the OCC 108 forwards the image data to the telematics unit 114 via the land network 106 and the mobile wireless network 104. In other implementations, the communication device 166A may transmit the image data corresponding to the image captured at step 200 directly to the telematics unit 114 along with a request to identify the vehicle components included in the image. In such implementations, the communication device 166A may transmit the image data to the telematics unit 114 of the vehicle 102 via a short range wireless communication connection, e.g. BLURTOOTH, WiFi, or BLE, or via the mobile wireless network 104 (and also via the land network 106).

In implementations where the communication device 166A partially performs the processing necessary to identify the vehicle components included in the image and partially outsources the processing necessary to identify the vehicle components included in the image, the communication device 166A can perform some amount of processing prior to transmitting the image data corresponding to the image captured at step 200 along with the request to identify the vehicle components included in the image. In such implementations, the communication device 166A can decide to transmit the image data directly to the telematics unit 114 or directly to the servers 144 of the OCC 108 depending upon the result of the initial processing of the image data. Some such implementations also contemplate that only a portion of the image data captured at step 200 is transmitted along with the request to identify vehicle components included in the image data. For example, preprocessing routines can be executed by the communication device 166A that determine only certain portions of the image are candidates for including an identifiable vehicle component and only those portions of the image are transmitted with the request to identify vehicle components at step 210.

Additionally at step 210, regardless of whether the communication device 166A performs a portion of the processing necessary for identification of the vehicle components included in the image or outsources the entirety of the processing to the telematics unit 114 and the OCC 108, the communication device 166A receives signals from one or both of the telematics unit 114 and the OCC 108 that carry information that indicates what vehicle components were identified in the image by the telematics unit 114 and/or the OCC 108. In some implementations, the communication device 166A can perform additional vehicle component identification processing after receiving responses from one or more of the telematics unit 114 and the OCC 108. In implementations where the communication device 166A receives a response from both the telematics unit 114 and the OCC 108, the communication device 166A can integrate the responses received from both the telematics unit 114 and the OCC 108 in order to determine a comprehensive list of identified vehicle components included in the image captured at step 200. The comprehensive list of identified vehicle components included in the image captured at step 200 can be stored as individual entries (or, e.g., as a single array data structure) within a vehicle component identifier field of the data structure created at step 210. Each entry in the vehicle identifier field of the data structure created at step 210 can be linked to an entry in an identified component region coordinate field of the data structure created at step 210.

At step 220, the process requests information corresponding to the vehicle components identified at step 210. The information requested by the communication device 166A at step 220 depends upon the identity of the vehicle components identified at step 210. Similarly, the location from which the communication device 166A requests the information also depends upon the identity of the components identified at step 210. In some implementations, the vehicle components identified at step 210 can be assigned to one or more categories and the source from which information pertaining to the vehicle component is requested is determined according to the category to which the identified vehicle components have been assigned. For example, a vehicle component identified at step 210 can be assigned to a category that includes interfaces for providing user input to the vehicle. Under such circumstances, the communication device 166A can request information pertaining to the use of such interfaces by a user from the databases 146 of the OCC 108. Alternatively, a vehicle component identified at step 210 could be assigned to a category that includes vehicle components with a dynamic status monitored by a diagnostic sensor, such as one of the vehicle sensors 139. Under such circumstances, the communication device 166A can request information pertaining to the current status of the vehicle component directly from the telematics unit 114 of the vehicle, or alternatively, indirectly from the telematics unit 114 of the vehicle via the OCC 108.

At step 230, the process receives information corresponding to the vehicle components identified at step 210 for which information was requested at step 220. The process can receive information directly from the entity to which the request for information was transmitted at step 220, or alternatively, the process can receive information indirectly from the entity to which the request for information was transmitted through another entity. For example, the process executing on the communication device 166A can transmit a request for diagnostic information pertaining to a tire of the vehicle 102 from the telematics unit 114 at step 220 and receive the diagnostics information from the OCC 108. In some implementations, the process can request information pertaining to a vehicle component identified at step 210 to multiple entities at step 220 and receive information corresponding to the identified vehicle component from multiple entities at step 230. In such circumstances, the process can integrate the information received from multiple entities at step 230 into a single data structure that includes all information received for a particular vehicle component identified at step 210.

Figure 4:
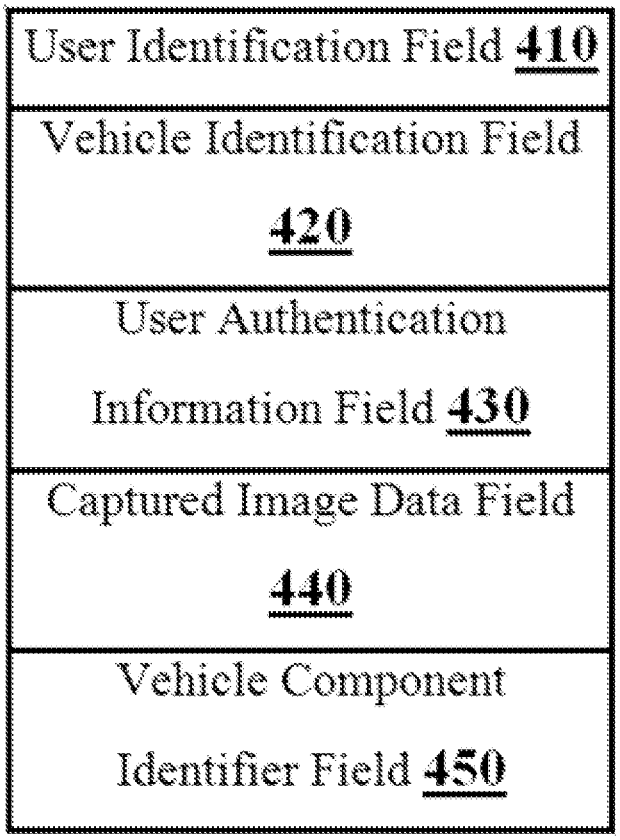
FIG. 4 is an example diagram of a data structure utilized in a process for interactively providing access to vehicle user information.

At step 230, the process creates a data structure, such as the data structure depicted in FIG. 4. The data structure depicted in FIG. 4 includes, by way of example, vehicle user identification field 410, vehicle identifier field 420, vehicle user authentication information field 430, a captured image data field 440, and a vehicle component identifier data field 450. The data structure created at step 230 can be populated with fields of the data structure created at step 210 or can be populated with entries having values obtained independently from the data structure created at step 210. The data structure depicted in FIG. 4 is merely an example and alternative data structures that omit particular fields depicted in FIG. 4 or include additional fields not depicted in FIG. 4 are also contemplated herein.

The vehicle user identification field 410 can store a vehicle user identification entry that indicates the identity of a user of the communication device 166A or of a user of the vehicle 102 and the vehicle identifier field 420 can store a vehicle identifier entry that corresponds to the vehicle 102 and that can indicate the make and model of the vehicle 102. An entry in the vehicle identifier field 420 can also store identifiers for a make and model of one or more components of the vehicle 102 or a pointer to another data structure from which information regarding the make and model of the one or more components of the vehicle 102 can be obtained. The vehicle user authentication information field 430 can store an entry at which authentication certificates corresponding to one or more of a vehicle user identifier entry stored at the vehicle user identification field 410 and a vehicle identifier entry stored at the vehicle identifier field 420. The captured image data field 440 can include image data corresponding to the image captured at 200. The vehicle component identifier data field 450 can include one or more entries that each correspond to a component of the vehicle 102 identified in the image captured at 200. The entries of the vehicle component identifier data field 450 can be vehicle component data structures that include various fields representative of various characteristics of the vehicle components that they represent.

The data structure depicted in FIG. 4 can be stored at a single location or distributed across multiple locations. For example, a portion of the data structure depicted in FIG. 4 can be stored at the databases 146 of the OCC 108 while another portion of the data structure depicted in FIG. 4 is stored at the vehicle 102. Similarly, multiple copies of all or a portion of the data structure depicted in FIG. 4 can be stored at multiple locations. Various fields of the data structure depicted in FIG. 4 can also include a pointer to a field of a data structure stored at a different location. For example, a data structure corresponding to the data structure depicted in FIG. 4 or a portion thereof stored at the vehicle 102 can include a pointer to a data structure corresponding to the data structure depicted in FIG. 4 or a portion thereof stored at the OCC 108.

At step 240, the process provides information corresponding to the identified vehicle components in the image captured at step 200 via a graphical user interface (GUI). The GUI provided at step 240 includes the original image captured at step 200 along with an overlay on the image that includes various portions of the information received at step 230. The process can create the GUI at step 240 by adding overlay data to the image data stored in the captured image data field 440 of the data structure created at step 230. In some circumstances, the overlay only includes a portion of the information corresponding to the identified vehicle components and received at step 230 but includes one or more widgets that allow a user to request information received at step 230 but not initially included in the overlay of the GUI provided at step 240. The information included in the overlay at step 240 can include status information about various vehicle components overlayed over the portion of the image that contains the vehicle component to which the status information pertains. Additionally, the information included in the overlay at step 240 includes a user's guide that provides instruction on how to use certain functions and features of the vehicle 102.

In providing the information corresponding to the identified vehicle components, the process determines the location of the identified vehicle components within the image and determines a mode of display of the information pertaining to the identified vehicle components. The mode of display of the information pertaining to the identified vehicle components can be selected from a group of possible information display modes based on the size of the identified vehicle component relative to the overall size of the image captured at step 200, the size of the output device used to provide the information corresponding to the identified vehicle components, and the field of view of a user viewing the output device.

In some implementations, the GUI provided at step 240 provides an option to toggle between a vehicle diagnostic mode and a vehicle user guide mode. In the vehicle diagnostic mode, all information included in the overlay initially displayed at step 240 that provides instruction or guidance on how to operate a particular vehicle feature is hidden and only information that provides current status information of the vehicle is included in the GUI. In the vehicle user guide mode, all information pertaining to the current status of the vehicle is hidden while information providing guidance or instruction on how to implement certain vehicle features or how to interact with a particular human-machine interface (HMI) of the vehicle is displayed.

At optional step 250, the process performs an automatic configuration of the vehicle components identified at step 210 that are subject to an automatic configuration. Alternatively, the process performs an automatic configuration of vehicle components identified at step 210 that are subject to an automatic configuration and that are also selected by a user from the GUI provided at step 240. By way of example, the process can perform an automatic configuration at step 250 of a radio of the vehicle 102 that was identified in the image data captured at 200. The automatic configuration of an identified component of the vehicle 102 can include transmitting a request to the OCC 108 for vehicle user settings for the identified component that correspond to an entry stored in the vehicle user identification field of the data structure created at step 230, receiving vehicle user settings for the identified component from the OCC 108, and transmitting the vehicle user settings for the identified component to the telematics unit 114 of the vehicle 102 along with an instruction to configure the identified component of the vehicle 102 with the transmitted vehicle user settings for the identified component. In this manner, as a result of capturing an image with the communication device 166A, the process allows, e.g., a radio of a vehicle to be automatically configured with a subscriber's personalized radio station presets, a driver's seat to be automatically configured with a subscriber's personalized seat position settings, one or more processor executable applications corresponding to visual application icons and loaded at the vehicle to be configured with a subscriber's personalized application settings, one or more steering wheel controls to be automatically configured according to a subscriber's preferred driving modes, etc.

Also at optional step 250, the process can automatically provide instructions and other information pertaining to the use of user interfaces for providing information to the vehicle and other vehicle controls. By way of example, the process can automatically provide instructions for using a cruise control feature of a vehicle in response to the capture of an image include a cruise control button of a vehicle and provide instructions for operation a navigation system of a vehicle in response to the capture of an image that includes controls of the navigation system.

Figure 5:
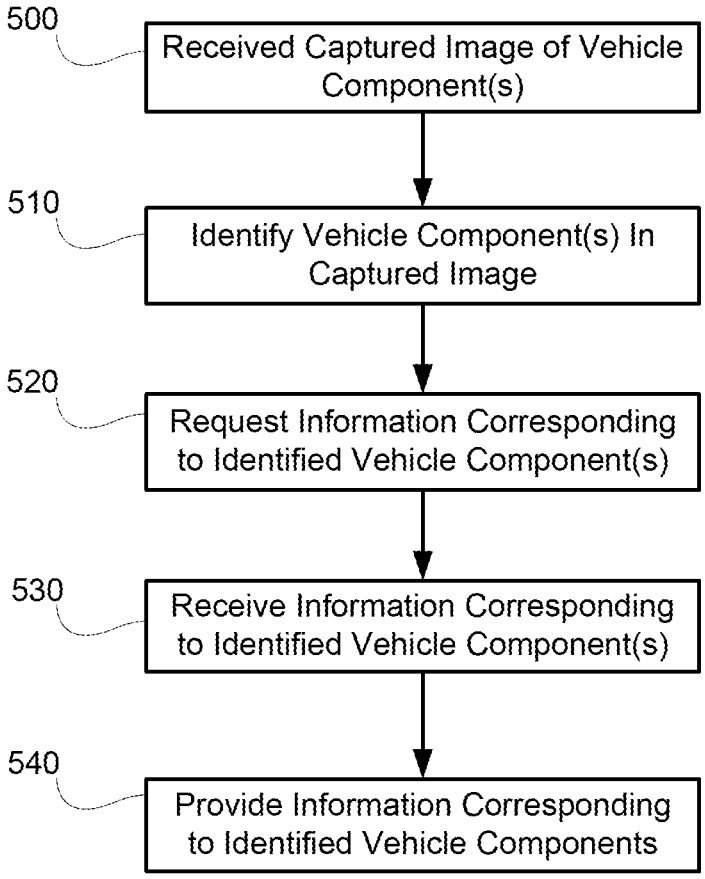
FIG. 5 is a flow diagram illustrating a process implemented by an operations control center of a telematics service provider for interactively providing access to vehicle information.

FIG. 5 is a flow diagram illustrating a process implemented by the OCC 108 for interactively providing access to vehicle information. Implementations described herein contemplate that the process depicted in FIG. 5 can be implemented by way of, e.g., an application executing at the servers 144 of the OCC 108. At step 500, the process receives a captured image of a portion of the vehicle 102. The captured image of the portion of the vehicle received at step 500 is transmitted from, e.g., the communication device 166A. The captured image of the portion of the vehicle received at step 500 can be received by the OCC 108 directly from the communication device 166A via the land network 106. Alternatively, the captured image of the portion of the vehicle received at step 500 can be received by the OCC 108 indirectly from the communication device 166A via the telematics unit 114 of the vehicle 102.

At step 510, the process identifies vehicle components in the captured image. For example, the vehicle components in the captured image can be identified through processing routines that are executed entirely at the OCC 108 or through processing routines that are distributed between the OCC 108, the communication device 166A, and the telematics unit 114. The processing routing executed at step 510 can include any of those described in connection with step 210 of FIG. 2, including creating a data structure such as that depicted in FIG. 3. For example, preprocessing routines that identify one or more portions of the image as candidates for containing an identifiable vehicle component can be executed at the communication device 166A prior to the receipt of the captured image of the portion of the vehicle at step 500. In such implementations, the result of the preprocessing routines can be transmitted to the OCC 108 along with the captured image of the portion of the vehicle at step 500.

The process can utilize a variety of information stored at the databases 146 during step 510 to ascertain the identities of any vehicle components that can be included in the image captured at step 500. For example, the process can query information pertaining to a subscriber of the TSP with which the communication device 166A (from which the image data was received at step 500) is associated. The information pertaining to the subscriber can include the make or model of one or more vehicles that are owned or frequently used by the subscriber. The information pertaining to the subscriber can thereafter be utilized by the call center 108 in order to identify the components that are included in the image received at step 500.

At step 520, the process requests information corresponding to the vehicle components identified at step 510. The information requested by the OCC 108 at step 520 depends upon the identity of the vehicle components identified at step 510. Similarly, the location from which the OCC 108 requests the information also depends upon the identity of the components identified at step 510. In some implementations, the vehicle components identified at step 510 can be assigned to one or more categories and the source from which information pertaining to the vehicle component is requested is determined according to the category to which the identified vehicle components have been assigned. For example, a vehicle component identified at step 510 can be assigned to a category that includes interfaces for providing user input to the vehicle. Under such circumstances, the OCC 108 can request information pertaining to the use of such interfaces by a user from the databases 146. Alternatively, a vehicle component identified at step 510 could be assigned to a category that includes vehicle components with a dynamic status monitored by a diagnostic sensor, such as one of the vehicle sensors 139. Under such circumstances, the OCC 108 can request information pertaining to the current status of the vehicle component directly from the telematics unit 114 of the vehicle.

At step 530, the process receives information corresponding to the vehicle components identified at step 510 for which information was requested at step 520. At step 540, the process provides the information corresponding to the identified vehicle components in the image captured at step 500 to a processor or group of processors that produce a GUI that includes the original image captured at step 500 along with an overlay on the image that includes the information received at step 530 (and potentially also includes additional information not received by the OCC 108 at step 530). For example, at step 540 the process can provide information corresponding to the identified vehicle components in the image captured at step 500 to the communications device 166A. At steps 530 and 540, the process can create a data structure such as that depicted in FIG. 4 and can populate the data structure in the manner discussed in connection with steps 230 and 240 of FIG. 2. At optional step 550, the process can facilitate an automatic configuration of the vehicle components identified at step 510 that are subject to an automatic configuration, and can also facilitate the automatic presentation of data pertaining to user controls in the manner described in connection with step 250 of FIG. 2.

Figure 6:
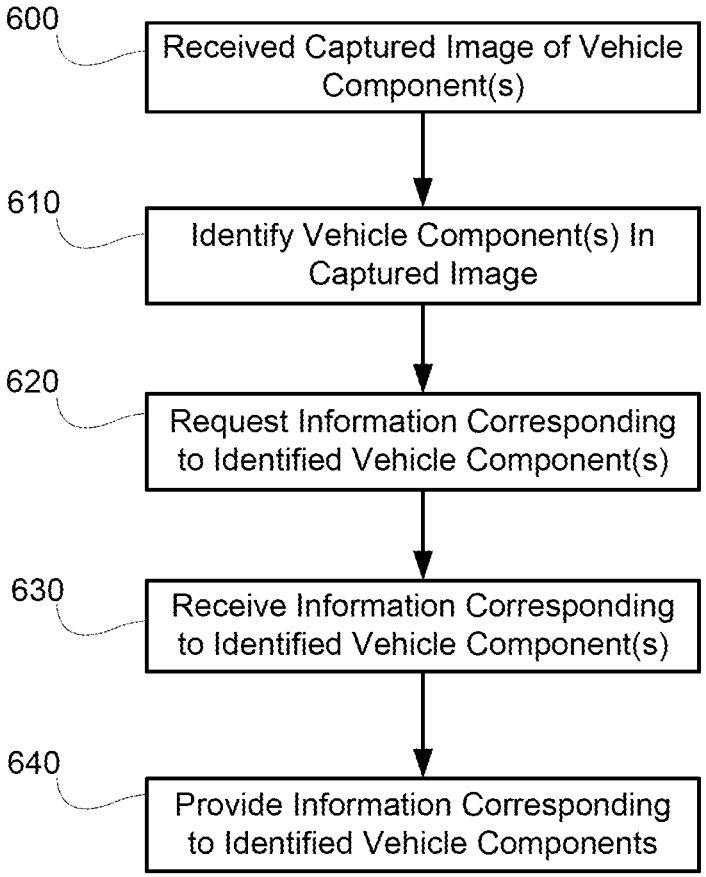
FIG. 6 is a flow diagram illustrating a process implemented by a telematics unit of a vehicle for interactively providing access to vehicle information.

FIG. 6 is a flow diagram illustrating a process implemented by a telematics unit of a vehicle for interactively providing access to vehicle information. Implementations described herein contemplate that the process depicted in FIG. 6 can be implemented by way of, e.g., an application executed by the electronic processing device 128 at the telematics unit 114 of the vehicle 102. At step 600, the process receives a captured image of a portion of the vehicle 102. The captured image of the portion of the vehicle received at step 600 is transmitted from, e.g., the communication device 166A or the OCC 108. In some implementations, only a portion of the entire image that was initially captured is received by the process at step 600 and instead only a group of portions of an image are received. The captured image of the portion of the vehicle received at step 600 can be received by the telematics unit 114 directly from the communication device 166A via a short range wireless network. Alternatively, the captured image of the portion of the vehicle received at step 600 can be received by the telematics unit 114 indirectly from the communication device 166A via the OCC 108.

At step 610, the process identifies vehicle components in the captured image. At step 610, identifying vehicle components in the captured image can include any of the processing routines described in connection with step 210 of FIG. 2, including creating a data structure such as that depicted in FIG. 3. The actions taken at step 610 can include the transmission of requests to perform vehicle component identification along with image data to one or more additional processors located remotely from the telematics unit 114. Such requests can be performed only after certain preprocessing routines are performed locally at the telematics unit 114.

At step 620, the process requests information corresponding to the vehicle components identified at step 610. The information requested by the telematics unit 114 at step 620 can depends upon the identity of the vehicle components identified at step 610. Similarly, the location from which the process depicted in FIG. 6 requests the information also depends upon the identity of the components identified at step 610. For example, the telematics unit 114 can request information from any of the vehicle sensors 139 or from a variety of electronic control units (ECUs) of the vehicle, such as an engine control module (ECM), a transmission control module (TCM), a powertrain control module (PCM), an electronic brake control module (EBCM), an anti-lock brake system (ABS) or a body control module (BCM), a door control unit (DCU), a seat control unit (SCU), and numerous other control modules that manage the various electronic systems in the vehicle.

At step 630, the process receives information corresponding to the vehicle components identified at step 610 for which information was requested at step 620. For example, a variety of diagnostic information and vehicle status information can be received at step 630 from any of the vehicle sensors 139 or any of the ECUs. At step 640, the process provides the information corresponding to the vehicle components identified at step 610 to a processor or group of processors that produce a GUI that includes an original image of a portion of the vehicle along with an overlay on the image that includes the information received at step 630 (and potentially also includes additional information not received by the telematics unit 114 at step 630). At steps 630 and 640, the process can create a data structure such as that depicted in FIG. 4 and can populate the data structure in the manner discussed in connection with steps 230 and 240 of FIG. 2. At optional step 650, the process can implement an automatic configuration of the vehicle components identified at step 610 that are subject to an automatic configuration by executing instructions to implement an automatic configuration provided in the manner described in connection with step 250 of FIG. 2.

It will be appreciated by those of skill in the art that the execution of the various machine-implemented processes and steps described herein can occur via the computerized execution of computer-executable recommendations stored on a tangible computer-readable medium, e.g., RAM, ROM, PROM, volatile, nonvolatile, or other electronic memory mechanism. Thus, for example, the operations performed by the telematics unit 114 can be carried out according to stored recommendations or applications installed on the telematics unit 114, and operation performed at the call center can be carried out according to stored recommendations or applications installed at the call center.

It is thus contemplated that other implementations of the invention can differ in detail from foregoing examples. As such, all references to the invention are intended to reference the particular example of the invention being discussed at that point in the description and are not intended to imply any limitation as to the scope of the invention more generally. All language of distinction and disparagement with respect to certain features is intended to indicate a lack of preference for those features, but not to exclude such from the scope of the invention entirely unless otherwise indicated.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method, using a computerized communication device having a processor, processor readable electronic storage media and a graphical display interface, for on-demand rendering and displaying, via the graphical display interface, information corresponding to a component of a vehicle as an overlay in an image including both the component and the corresponding information, the method comprising:

acquiring, using an image capture device, a current view image corresponding to a current view of a portion of the vehicle collected by the image capture device;

identifying the component of the vehicle depicted within the current view image;

requesting, using identification information resulting from identifying the component, the information corresponding to the component of the vehicle;

receiving, in response to the requesting, the information corresponding to the component of the vehicle;

rendering, using the information corresponding to the component, a combined image including both the current view image and an overlay image element corresponding to the information corresponding to the component of the vehicle; and displaying, via the graphical display interface, the combined image.

2. The method of claim 1 wherein identifying the component of the vehicle in the current view image comprises:

transmitting the image data corresponding to the current view image and a request to identify vehicle components included in the current view image to an operations control center (OCC) of a telematics service provider (TSP).

3. The method of claim 2, wherein identifying the component of the vehicle in the collected image further comprises:

identifying one or more portions of the current view image that are candidates for including a vehicle component; and assigning a class to each of the one or more portions of the current view mage that are candidates for including a vehicle component, wherein each assigned class corresponds to a set of identifiable vehicle components.

4. The method of claim 3, wherein transmitting the image data corresponding to the current view image consists of transmitting only image data corresponding to the one or more portions of the collected image that are candidates for including a vehicle component.

5. The method of claim 1, wherein identifying the component of the vehicle in the current view image comprises:

identifying a category of vehicle components to which the identified component of the vehicle belongs.

6. The method of claim 1, wherein requesting information corresponding to the component of the vehicle identified in the current view image comprises one of the group consisting of:

requesting information corresponding to the component of the vehicle identified in the current view image from an operations control center (OCC) of a telematics service provider (TSP), and requesting information corresponding to the component of the vehicle identified in the current view image from a telematics unit of the vehicle.

7. The method of claim 1, wherein receiving information corresponding to the component of the vehicle identified in the collected image comprises one of the group consisting of:

receiving information comprising instructions for using the component of the vehicle from an operations control center (OCC) of a telematics service provider (TSP), and receiving diagnostics information pertaining to the current condition of the component of the vehicle from a telematics unit of the vehicle.

8. The method of claim 1, wherein the overlay including the information corresponding to the component of the vehicle identified in the current view image includes one or more widgets that can be selected to provide additional information pertaining to the component of the vehicle.

9. The method of claim 1, wherein the overlay including the information corresponding to the component of the vehicle identified in the current view image includes a widget that allows a user to toggle between display of only information received from a telematics unit of the vehicle pertaining to the current condition of the component of the vehicle and display of only information received from an operations control center (OCC) of a telematics service provider (TSP) comprising instructions for using the component of the vehicle.

10. The method of claim 1, wherein identifying the component of the vehicle in the current view image comprises requesting information pertaining to a subscriber associated with the computerized communication device from an operations control center (OCC) of the telematics service provider (TSP).

11. The method of claim 10, wherein the information pertaining to a subscriber associated with the computerized communication device comprises a make and model of a vehicle associated with the subscriber.

12. A computerized communication device having a processor, processor readable electronic storage media and a graphical display interface, the electronic storage media having stored thereon instructions providing for performing a method on-demand rendering and displaying, via the graphical display interface, information corresponding to a component of a vehicle as an overlay in an image including both the component and the corresponding information, the method comprising:

acquiring, using an image capture device, a current view image corresponding to a current view of a portion of the vehicle collected by the image capture device;

identifying the component of the vehicle depicted within the current view image;

requesting, using identification information resulting from identifying the component, the information corresponding to the component of the vehicle;

receiving, in response to the requesting, the information corresponding to the component of the vehicle;

rendering, using the information corresponding to the component, a combined image including both the current view image and an overlay image element corresponding to the information corresponding to the component of the vehicle; and displaying, via the graphical display interface, the combined image.

13. The computerized communication device of claim 12, wherein identifying the component of the vehicle in the current view image comprises:

transmitting the image data corresponding to the collected image and a request to identify vehicle components included in the current view image to an operations control center (OCC) of a telematics service provider (TSP).

14. The computerized communication device of claim 13, wherein identifying the component of the vehicle in the current view image further comprises:

identifying one or more portions of the collected image that are candidates for including a vehicle component; and assigning a class to each of the one or more portions of the current view image that are candidates for including a vehicle component, wherein each assigned class corresponds to a set of identifiable vehicle components.

15. The computerized communication device of claim 14, wherein transmitting the image data corresponding to the current view image consists of transmitting only image data corresponding to the one or more portions of the collected image that are candidates for including a vehicle component.

16. The computerized communication device of claim 12, wherein identifying the component of the vehicle in the current view image comprises:

identifying a category of vehicle components to which the identified component of the vehicle belongs.

17. The computerized communication device of claim 12, wherein requesting information corresponding to the component of the vehicle identified in the current view image comprises one of the group consisting of:

requesting information corresponding to the component of the vehicle identified in the current view image from an operations control center (OCC) of a telematics service provider (TSP), and requesting information corresponding to the component of the vehicle identified in the current view image from a telematics unit of the vehicle.

18. The computerized communication device of claim 12, wherein receiving information corresponding to the component of the vehicle identified in the current view image comprises one of the group consisting of:

receiving information comprising instructions for using the component of the vehicle from an operations control center (OCC) of a telematics service provider (TSP), and receiving diagnostics information pertaining to the current condition of the component of the vehicle from a telematics unit of the vehicle.

19. The computerized communication device of claim 12, wherein the overlay including the information corresponding to the component of the vehicle identified in the current view image includes one or more widgets that can be selected to provide additional information pertaining to the component of the vehicle.

20. A system for providing information about a component of a vehicle, the system comprising:

a computerized communication device having, a processor, processor readable electronic storage media and a graphical display interface, the electronic storage media having stored thereon instructions providing performing a method on-demand rendering and displaying, via the graphical display interface, information corresponding to a component of a vehicle as an overlay in an image including both the component and the corresponding information, the method comprising:

acquiring image data corresponding to an image of a portion of the vehicle collected by an image capture device, identifying the component of the vehicle in the collected image, requesting information corresponding to the component of the vehicle identified in the collected image, receiving information corresponding to the component of the vehicle identified in the collected image, and providing for display image data corresponding to the image collected by the image capture device and an overlay including the information corresponding to the component of the vehicle identified in the collected image;

acquiring, using an image capture device, a current view image corresponding to a current view of a portion of the vehicle collected the image capture device;

identifying the component of the vehicle depicted within the current view image;

requesting, using identification information resulting from identifying the component, the information corresponding to the component of the vehicle;

receiving, in response to the requesting, the information corresponding to the component of the vehicle;

rendering, using the information corresponding to the component, a combined image including both the current view image and overlay image elements corresponding to the information corresponding to the component of the vehicle; and displaying, via the graphical display interface, the combined image;

a telematics unit of the vehicle having a processor and processor readable electronic storage media having stored thereon instructions providing for;

receiving a request for information corresponding to the component of the vehicle identified in the current view image, and providing diagnostics information pertaining to a current condition of the component of the vehicle;

a server having a processor and processor readable electronic storage media having stored thereon instructions providing for;

receiving a request for information corresponding to the component of the vehicle identified in the current view image, and providing information comprising instructions for using the component of the vehicle.

* * * * *